United States Patent [19]

Wickman

[11] Patent Number: 4,679,670

[45] Date of Patent: Jul. 14, 1987

[54] WHEELED SUITCASE AND HANDLE

[75] Inventor: John A. Wickman, Swansea, Mass.

[73] Assignee: American Tourister, Inc., Warren, R.I.

[21] Appl. No.: 885,811

[22] Filed: Jul. 15, 1986

Related U.S. Application Data

[63] Continuation of Ser. No. 705,956, Feb. 27, 1985, abandoned.

[51] Int. Cl.[4] ..... A45C 5/14; A45C 13/26

[52] U.S. Cl. ..... 190/18 A; 190/39; 190/115; 16/110 R; 280/37

[58] Field of Search ..... 280/37; 190/18 A, 115, 190/39; 16/47, 110 R

[56] References Cited

U.S. PATENT DOCUMENTS

| | | | |
|---|---|---|---|
| 606,462 | 6/1898 | Kennedy-McGregor | 16/47 |
| 1,194,780 | 8/1916 | Pauey et al. | 16/47 X |
| 1,822,893 | 9/1931 | Kapolkin | 190/18 A |
| 2,463,391 | 3/1949 | Kanaley | 190/18 A |
| 2,596,578 | 5/1952 | McIntyre et al. | 190/18 A X |
| 3,009,551 | 11/1961 | Kotkins | 190/115 |
| 3,057,636 | 10/1962 | D'Ettorre et al. | 280/37 |
| 3,526,921 | 9/1970 | Aupke | 190/18 A |
| 3,655,215 | 4/1972 | Becklin | 190/18 A X |
| 4,094,391 | 6/1978 | Ratchford | 190/115 X |
| 4,377,883 | 3/1983 | Folson | 16/47 |
| 4,385,415 | 5/1983 | Volz | 190/18 A X |
| 4,418,804 | 12/1983 | Bradley et al. | 190/18 A |

FOREIGN PATENT DOCUMENTS

| | | | |
|---|---|---|---|
| 15827 | 9/1980 | European Pat. Off. | 190/115 |
| 106906 | 5/1984 | European Pat. Off. | 190/18 A |
| 59346 | 1/1954 | France | 190/18 A |
| 58-196620 | 12/1983 | Japan . | |
| 1093924 | 12/1967 | United Kingdom | 190/115 |
| 1180397 | 2/1970 | United Kingdom | 190/115 |

*Primary Examiner*—William Price
*Assistant Examiner*—Sue A. Weaver
*Attorney, Agent, or Firm*—F. Kristen Koepcke; Brian J. Leitten

[57] ABSTRACT

An improved suitcase construction is disclosed which comprises an inclined handle which permits the force of the movement of the center of gravity of a person who holds the handle to be translated to the suitcase in the direction of movement to allow the suitcase to be moved with a minimum of effort. The suitcase also comprises a plurality of casters, wherein the rear casters have outer diameters greater than the outer diameters of the front casters to provide increased stability and direction changing capability during the movement.

11 Claims, 6 Drawing Figures

WHEELED SUITCASE AND HANDLE

BACKGROUND AND OBJECTS OF THE INVENTION

This is a continuation of application Ser. No. 705,956, filed Feb. 27, 1985, now abandoned.

The present invention relates to a wheeled suitcase and a handle for a wheeled suitcase. In particular, the present invention relates to a suitcase having casters attached to its lower surface and an inverted U-shaped handle attached to its upper surface. The suitcase is distinguished by the angle of inclination of the grip portion of the inverted U-shaped handle with respect to the floor surface with which the casters make contact. The suitcase is also distinguished by the fact that the rear casters have a larger outer diameter than the front casters.

In the past, various attempts have been made to provide wheeled suitcases for use by travelers. A variety of configurations have been attempted. For example, wheels have been placed on the lower surface of a suitcase having a height less than its length, and a leash attached to the upper surface or end panel of the suitcase for pulling the case. In another attempt, wheels were attached to one end panel of such a suitcase, and a standard handle placed on the other end panel. In this manner, the suitcase could be stood on one end with the wheels contacting the floor surface. Such previous attempts have resulted in an unstable suitcase configuration which results in wobbling and tipping over of the suitcase when transported. Furthermore substantial force was required to move or pull the suitcase in the direction of the traveler's movement.

It is therefore an object of the present invention to provide a wheeled suitcase which may be easily transported with a minimum of effort on the part of the user.

Another object of the present invention is to provide a wheeled suitcase which has enhanced stability during movement and which facilitates changing the direction of movement.

SUMMARY OF THE INVENTION

These and other objects are achieved by the present invention, which is directed to a wheeled suitcase having front and rear wheels or casters attached to the lower surface thereof, with the rear wheels or casters having a larger outer diameter than the front casters. On its upper surface, an inverted U-shape handle is attached. The U-shaped handle has two riser sections and a gripping section. The front riser section is of a greater length than the rear riser section, positioning the gripping section at an angle of inclination with respect to the floor surface with which the casters make contact.

THE DRAWINGS

The objects and advantages of the present invention will become apparent from the following detailed description of the preferred embodiments thereof, in connection with the accompanying drawings in which like numerals designate like elements, and in which.

DETAILED DESCRIPTION OF THE PREFERRED EMBODIMENTS OF THE PRESENT INVENTION

In accordance with the present invention, there is provided an improved suitcase which may easily be transported and which is configured to be conveniently accessed by a traveler.

While the invention is described in reference to a suitcase, and it is generally applicable to any container which must be moved or transported.

Figure 1:
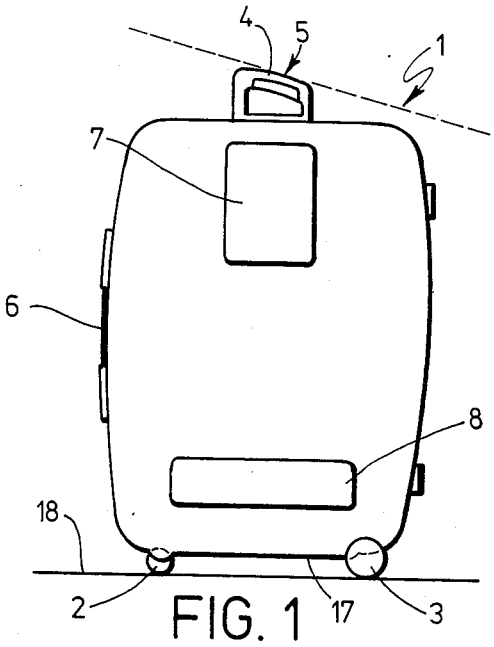
FIG. 1 is a side elevational view of the suitcase of the present invention.
Figure 4:
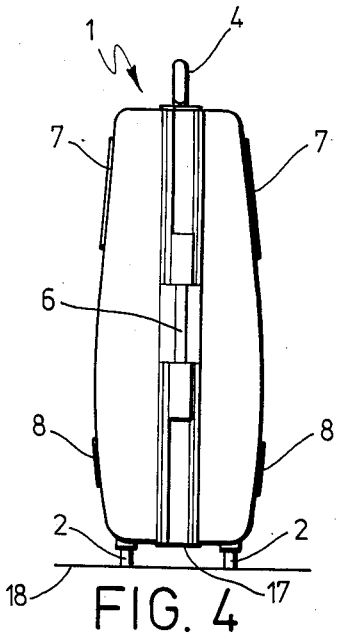
FIG. 4 is a front elevational view of the suitcase of the present invention.

As may be seen from FIG. 1, suitcase 1 has the shape of a hollow, generally rectangular solid. That is, suitcase 1 comprises two generally vertical parallel side panels having two generally vertical edges and two generally horizontal edges, two generally vertical parallel end panels having two generally vertical edges and two generally horizontal edges and is attached along the vertical edges thereof to the vertical edges of said side panels. A generally horizontal top panel having a generally rectangular shape is attached along its edges to the upper generally horizontal edges of the side panels and the end panels. A generally horizontal bottom panel having a generally rectangular shape is attached along its edges to the lower generally horizontal edges of the side panels and the end panels. A handle is mounted to the top panel. At least two spaced apart rear wheels are movably mounted to the bottom panel at one end of thereof and in a direction generally parallel to the side panels. The rear wheels protrude at least partially below the bottom panel. At least one front wheel is movably mounted to the bottom panel at the other end thereof in a direction generally parallel to the side panels. The at least one front wheel protrudes at least partially below the bottom panel.

The container or suitcase of the present invention generally comprises a box member and a lid member hinged thereto. The box member and the lid member each comprise one of the side panels. Each of the end panels, the top panel and the bottom panel comprise two sections formed by separating each of these panels (end, top, bottom) along a line generally parallel to its length. One section of each of these panels forms a portion of the box member or the lid member. The box member and lid member are hinged along the separation line of one of the end panels.

Lower surface 17 of suitcase 1 is equipped with two front casters 2 and two rear casters 3 (only one front and rear caster shown). The upper surface of the improved suitcase is equipped with an inverted, U-shaped handle 4.

Figure 2:
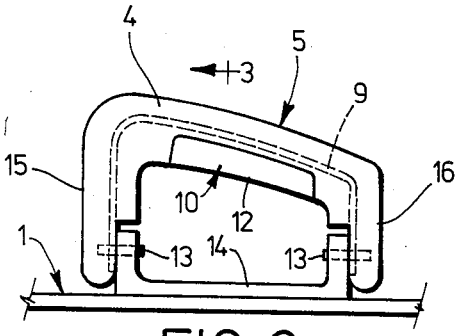
FIG. 2 is a side elevational view of the handle section of the suitcase of the present invention.

Handle 4 is a U-shaped unit manufactured, e.g., of a plastic material such as a molded synthetic resin. Any suitable material, such as fabric, leather or the like, may be employed to form handle 4. As may be seen from FIG. 2, handle 4 may incorporate an inner skeleton of reinforcing material 9. For example, a formed steel member, e.g., a U-shaped member, or other suitable reinforcing member may be employed. The front riser section 15 of handle 4 is of a length greater than the rear riser section 16. Preferably front and rear riser sections 15 and 16 are parallel to each other. The front and rear riser sections of handle 4 may be constructed of the same material as grip 5, or may be constructed of any other suitable material. Riser sections 15 and 16 and gripping section 5 may be of a unitary construction or may be separate sections joined together in any convenient manner.

Cushioning means, e.g., grip cushion 10, comprises a section or portion of grip 5 that comes in contact with the fingers when handle 4 is grasped by a traveler. Grip cushion 10 may comprise, e.g., a soft, resilient material 11, such as a plastic sponge material covered with leather, fabric, or the like 12. Typically, the grip cushion is located in the lower portion of grip 5.

Handle 4 is secured to the suitcase 1 by any convenient means. For example, two hinges 13 located at the ends of risers sections 15 and 16 may be used to secure handle 4 directly to suitcase 1 or to an intermediate attachment means, e.g., attachment frame 14. Since front riser 15 is of a length greater than rear riser 16, grip 5 of handle 4 is inclined down toward the rear of suitcase 1 in relation to floor surface 18 with which casters 2 and 3 make contact. With this orientation, the force of the center of gravity of a person who holds handle 4 while walking is effectively translated to suitcase 1 in the direction of movment. This permits suitcase 1 to be moved with a minimum of effort in comparison to the conventional suitcase in which the handle is parallel to the contact floor surface.

Attachment frame 14 is secured to suitcase 1 for receiving handle 4 and attaching handle 4 to suitcase 1. Attachment means 14 may comprise a bracket having a generally horizontal center section secured to said opposite side of suitcase and two end sections generally perpendicular to the center section and protruding in a direction away from suitcase 1 and having means in its free end to receive handle 4 at the free ends of front and rear riser sections. Attachment means 14 may be unitary or may comprise a pair of separate attachment means. Preferably, handle 4 is movably fastened in any convenient manner to attachment means 14 in a manner which permits handle 4 to be rotated about an axis generally parallel to the side of suitcase 1 on which it is mounted and along a line formed by said receiving means. Hinges 13 may be integral to attachment frame 14 or may be separate pieces.

Figure 3:
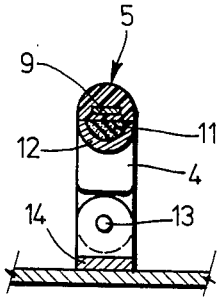
FIG. 3 is a sectional view of the handle section of the suitcase of the present invention, taken along the line 3—3.
Figure 5:
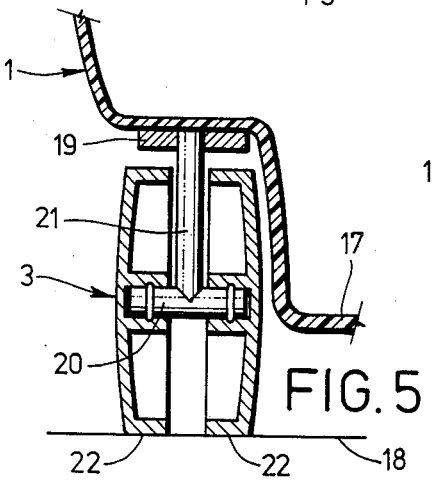
FIG. 5 is a cross-sectional view of the rear caster attached to the lower surface of the suitcase of the present invention.
Figure 6:
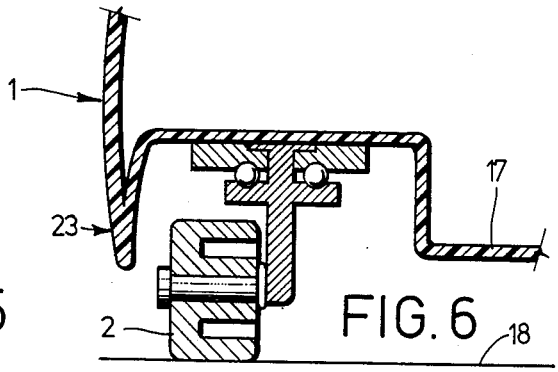
FIG. 6 is a cross-sectional view of the front caster attached to the lower surface of the suitcase of the present invention.

FIG. 3 is a cross-sectional view of handle 4, showing the construction of the grip section, the grip cushion and the hinges.

Handle 6 is also provided for carrying the suitcase manually. Non-skid panels 7 and 8 may be attached to suitcase 1 to act as the dampers to prevent movement caused, e.g, by vibration when a suitcase has been loaded on a transportation cart or into a loading bay, and to act as guards to insure that the suitcase is not damaged, and to improve the appearance of the suitcase.

Rear casters 3 have diameters greater than front casters 2. Rear casters 3 may be conveniently attached to the lower surface 17 of suitcase 1. A single, freely revolving wheel or a plurality of wheels may be employed. Support rods 21 are set in washers 9. Support rods 21 support axles 20, which in turn support two wheels 22 independently attached to axles 20. In this manner, wheels 22 may revolve freely. In the preferred embodiment, a single wheel is mounted to axel 20, which is supported by a support plate.

Front casters 2 are mounted in a conventional manner with horizontally rotating axles equipped with casters that freely rotate. Casters 2 may be free to rotate about vertical and horizontal axes. Wheel cover section 23 provides a guarding surface for front casters 2. Wheel cover section 23 may be a unitary portion of suitcase 1 or may be a separately attached unit. Both front and rear casters 2 and 3 are inset into recessed areas on the lower surface 17 of suitcase 1. The depth of the recessed areas differs for the front and rear casters so that the contact floor surface 18 and the major portion of lower surface 17 of suitcase 1 are substantially parallel.

In this manner, a greater load is placed on the rear casters than on the front casters by the combination the the inertia of the suitcase and the force applied through handle 4. The peripheral speed of the caster wheels also varies when the direction of suitcase movement is changed, especially when cornering.

The installation of rear casters 3 with outer diameters larger than that of front casters 2 decreases the number of revolutions of the rear casters, thus assuring stability when used over uneven surfaces. Independent revolution of the two rear caster wheels also provides improved stability during movement, quieter operation, and facilitates changing the direction of movement.

While it is generally preferred to have a suitcase where the handle 4 and casters 2 and 3 are mounted on the shorter top and bottom panels of the suitcase, with handle 6 being mounted on one of the longer end panels of the suitcase, any desirable configuration may be employed. It is also possible to locate the handle 4 at any convenient location along the upper surface or top panel of the suitcase. It is, however, preferred to locate the handle 4 in the center of the upper surface of suitcase 1 and to locate front and rear casters 2 and 3 at a substantial distance from each other.

Although the present invention has been described in connection with the preferred embodiments thereof, it will be appreciated by those skilled in the art that additions, modifications, substitutions and deletions not specifically described may be made without departing from the spirit and scope of the invention as defined in the appended claims;

What is claimed is:

1. An improved suitcase of the shape of a hollow, generally rectangular solid which comprises:

(a) two generally vertical parallel side panels having two generally vertical edges and two generally horizontal edges;

(b) two generally vertical parallel end panels having two generally vertical edges and two generally horizontal edges and being attached along the generally vertical edges thereof to the vertical edges of said side panels;

(c) a generally horizontal top panel having a generally rectangular shape and being attached along its edges to the upper generally horizontal edges of said side panels and said end panels;

(d) a generally horizontal bottom panel having a generally rectangular shape and being attached along its edges to the lower generally horizontal edges of said side panels and said end panels;

(e) at least two spaced apart rear wheels movably mounted to said bottom panel at one end thereof and in a direction generally parallel to said side panels, said rear wheels protruding at least partially below the said bottom panel;

(f) at least one front wheel movably mounted to said bottom panel at the other end thereof in a direction generally parallel to said side panels, said at least one front wheel protruding at least partially below the said bottom panel, the diameters of said at least two rear wheels being greater than the diameter of said at least one front wheel, and said at least one front wheel being on the leading position of said bottom panel during transport of said suitcase upon said wheels;

(g) a first handle means attached to one of said end panels, said first handle means being adapted to allow carrying of said suitcase without the use of said front and rear wheels; and (h) a second handle means attached to said top panel and being adapted for movement of said suitcase on said front and rear wheels, said second handle means comprising a front riser section at the leading portion thereof, a rear riser section at the following portion thereof, and a gripping section intermediate and connected to said front and rear riser sections, said front riser section being of a length greater than the length of said rear riser section, with the distance between said gripping section and said top panel of said suitcase increasing in the direction of movement of said suitcase when transported upon said wheels by means of a manual force applied to the gripping section of said suitcase through said handle, the angle of inclination of said gripping section being away from the normal direction of travel of said suitcase and toward said rear wheels.

2. The invention according to claim 1 wherein said front and rear riser sections of said second handle means are generally parallel.

3. The invention according to claim 1 wherein said front riser section, said rear riser section and said gripping section of said second handle means comprise a unitary construction.

4. The invention according to claim 1 wherein said second handle means further comprises a cushioning means mounted on the portion of said gripping section which faces said top panel.

5. The invention according to claim 1 further comprising hinge means located at the ends of said front riser section and said rear riser section for movably securing said second handle means to said top panel of said suitcase.

6. The invention according to claim 5 further comprising attachment means secured to said suitcase for receiving said second handle means and attaching said second handle means to said top panel of said suitcase.

7. The invention according to claim 6 wherein said attachment means comprises a bracket having a generally horizontal center section secured to said top panel of said suitcase and two end sections generally perpendicular to said center section and protruding in a direction away from said top panel of said suitcase and having means to receive said second handle means at the free ends of said front and rear riser section.

8. The invention according to claim 7 wherein said second handle means is movably fastened to said attachment means in a manner which permits said second handle means to be rotated about an axis generally parallel to said top panel of said suitcase and along a line formed by said receiving means.

9. The invention according to claim 1 wherein said two rear wheels comprise a pair of spaced apart casters, each said caster comprising at least two parallel, independently mounted, freely rotating wheels and wherein said at least one front wheel comprises two parallel, independently mounted, spaced apart wheels which freely rotate.

10. The invention according to claim 1 wherein said at least one front wheel freely rotates about vertical and horizontal axes.

11. The invention according to claim 1 wherein said suitcase comprises a box member and a lid member hinged thereto, said box member and said lid member each comprising one of said two side panels, and said box member and said lid member each comprising a portion of said top and bottom panels and said end panels.

* * * * *